US005821644A

United States Patent [19]

Sommer

[11] Patent Number: 5,821,644

[45] Date of Patent: Oct. 13, 1998

[54] SAFETY SYSTEM FOR PASSAGE CLOSURE MEMBERS

[76] Inventor: Frank-Uwe Sommer, Schönbergstrasse 27, D-7312 Kirchheim, Germany

[21] Appl. No.: 157,163

[22] PCT Filed: May 23, 1992

[86] PCT No.: PCT/EP92/01164

§ 371 Date: Dec. 7, 1993

§ 102(e) Date: Dec. 7, 1993

[87] PCT Pub. No.: WO92/21845

PCT Pub. Date: Dec. 10, 1992

[30] Foreign Application Priority Data

Jun. 7, 1991 [DE] Germany ..... 41 18 782.2

[51] Int. Cl.[6] ..... F05F 15/02

[52] U.S. Cl. ..... 307/326; 49/27; 49/28; 318/283; 318/469

[58] Field of Search ..... 307/326; 49/26, 49/27, 28; 318/280–286, 466–469

[56] References Cited

U.S. PATENT DOCUMENTS

| | | | |
|---|---|---|---|
| 4,369,399 | 1/1983 | Lee et al. | 318/467 |
| 4,638,433 | 1/1987 | Schindler | 49/28 |
| 4,896,714 | 1/1990 | Ellis | 160/311 |
| 5,027,552 | 7/1991 | Miller et al. | 49/27 |

FOREIGN PATENT DOCUMENTS

| | | |
|---|---|---|
| 3514223 | 3/1987 | Germany . |
| 3546282 | 1/1991 | Germany . |

OTHER PUBLICATIONS

Nippon Denso K.K. and Makoto Asou, "Automatic Opening and Closing Device of a Window for Vehicle", *Patent Abstracts of Japan,* vol. 9, No. 219 (1985).

*Primary Examiner*—William M. Shoop, Jr.
*Assistant Examiner*—Jonathan S. Kaplan
*Attorney, Agent, or Firm*—Speckman, Pauley & Fejer

[57] ABSTRACT

A safety device for a passage closure, such as a garage door, having a drive, a maximum permissible load value which can be set, and a control device by which the drive can be switched off, switch-off occurring when the maximum permissible load value has been reached and a signal $S_2$ is sent to the control device at a time $T_2$. A sensor is disposed in the area of the leading edge of the closure. When the sensor encounters an obstacle, it emits a signal $S_1$ to the control device at a time $T_1$. Upon reaching the maximum permissible load, the control device determines a $\Delta T$ based on $T_2-T_1$, compares it to a preset value and if the preset value is exceeded, changes the direction of movement of the closure.

14 Claims, 1 Drawing Sheet

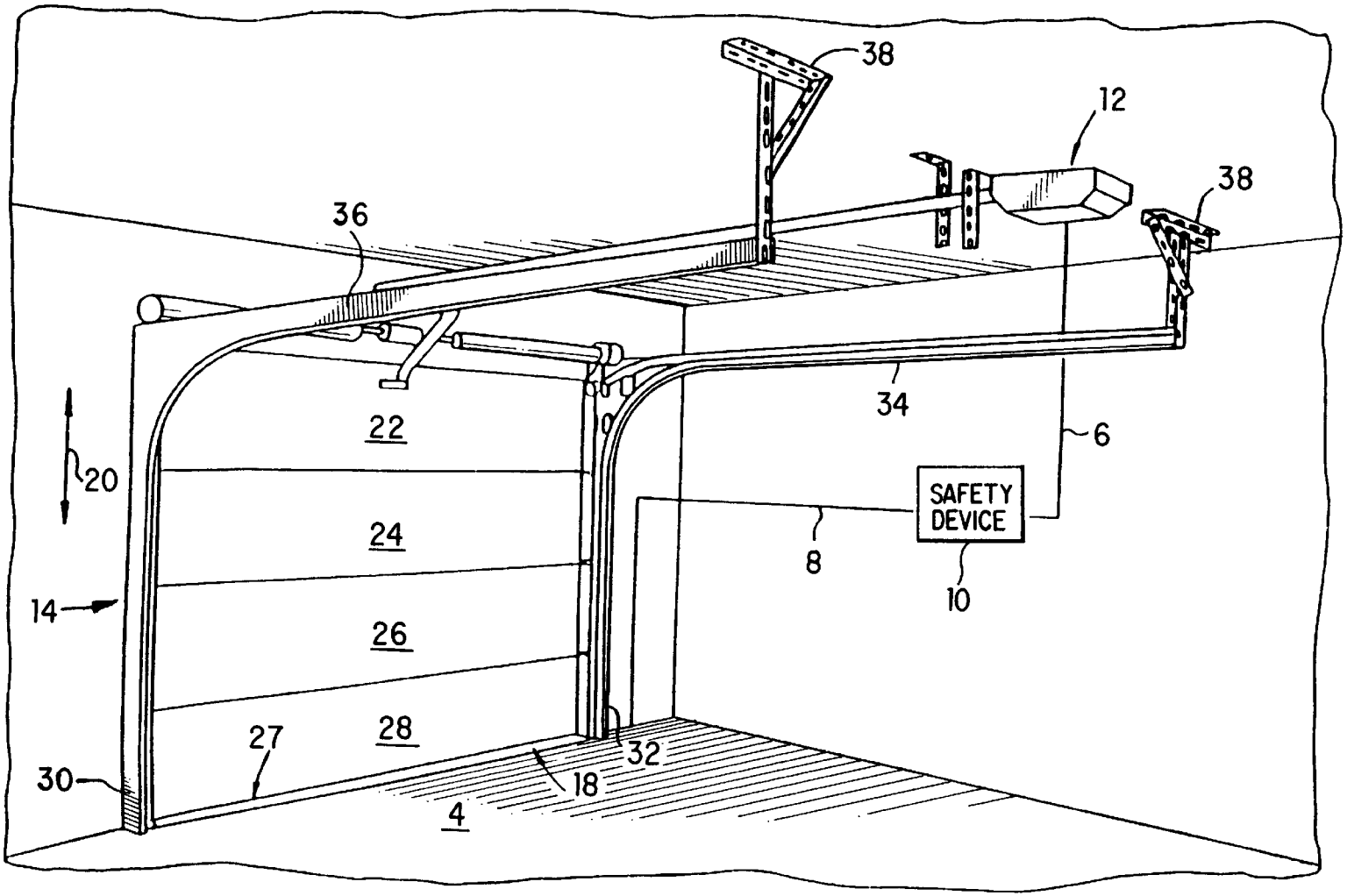
38
12
6
SAFETY DEVICE
10
34
38
8
32
18
4
22
24
26
28
36
27
20
14
30

SAFETY SYSTEM FOR PASSAGE CLOSURE MEMBERS

BACKGROUND OF THE INVENTION

1. Field of the Invention

This invention relates to a safety system for a passage closure such as a gate, window, door, sliding roof or the like having a drive, the maximum permissible load value of which can be set and having a control device by which the drive can be switched off, switch-off occurring when the maximally permissible load value has been reached, at which time a signal is sent to the control device.

2. Description of the Prior Art

Power-operated devices, such as gates, doors or windows, cooperate with an electromechanical drive, for example, which, in the case of garage doors, consists of a guide rail mounted on the garage ceiling, in which a carriage which is connected to the door by hinged bars is guided movable in a longitudinal direction by a drive motor and through an interlocked element. In this case, the interlocked element extends straight and parallel to the guide rail and is resiliently and fixedly suspended at both ends by springs. The drive is furthermore equipped with a blockage and obstacle circuit, such as described in German Patent Publication DE 35 46 282 C2. A garage door drive of this type is very responsive and operates safely, but it has the disadvantage that the drive cannot distinguish between the door resting on the ground and being in contact with an obstacle.

A method for switching off or reversing an electric motor for the drive of a movable passage closure is disclosed in German Patent Publication DE 35 14 223 C2, in which the increase of the current used by the motor is monitored and, when a preselected set value is exceeded, the motor is shut off or reversed into the opposite direction. This method can be used when the passage closure is a device which is relatively small and of light weight, such as windows, sliding roofs, or the like. However, this method cannot necessarily be employed with large devices, such as garage doors which encounter obstacles during closing, particularly when these obstacles are bodies, located in the area of the compression or closing edge, which can easily be destroyed.

SUMMARY OF THE INVENTION

Accordingly, it is an object of this invention to provide a safety device which, on the one hand, can determine whether the passage closure closes or has closed in accordance with the operating conditions or, on the other hand, can determine whether the passage closure is in contact with an obstacle. The safety device is such that when the passage closure comes into pressure contact with an obstacle, the latter is released. It is a further object of this invention to embody the safety device in such a way that the user is always informed whether the safety device and/or the drive device are operating correctly.

These objects are attained with the safety device in accordance with one embodiment of this invention comprising a sensor disposed in the area of compression and/or closing edge of the passage closure which, when encountering an obstacle, emits a signal to a control device. Upon reaching a maximally permissible load value, the control device generates a time differential, $\Delta T_{actual}=T_2-T_1$ and compares the value of said time differential with a preselected value, $T_{preselected}$. If $\Delta T_{actual}$ is greater than $T_{preselected}$, then the direction of the passage closure is changed.

Accordingly, the safety device of this invention comprises a time measuring device which is switched on by a signal $S_1$ at a time $T_1$ and measures the time $\Delta T_{actual}=T_2-T_1$ within which the operational load on the drive device is exceeded and emits a signal $S_2$ within the time period $T_2$. As a rule, these time periods are in the range of milliseconds. If the passage closure assumes the extended position, that is, it rests on the ground, the operational load is exceeded within a very short time after the signal $S_1$ has been emitted, so that the drive device is shut off and the movement of the passage closure is interrupted. If there is an obstacle, for example a person, in the movement path of the door, the person acts as a partially yielding obstacle, so that the preselected maximum operational load of the drive device is exceeded only after a longer time period following the emission of the signal $S_1$. This results in the safety device reversing the drive device, so that the passage closure moves in the opposite direction.

In accordance with a particularly preferred embodiment of this invention, the sensor is disposed in the area of the leading edge of the passage closure. The sensor is a resiliently deformable body extending along the leading edge. In accordance with a particularly preferred embodiment, the sensor is a body made of rubber or plastic, filled with gas or a liquid, and is connected by a line to a converter of mechanical pulses into electrical pulses.

An advantage of the safety device of this invention is that it is possible to equip conventional gates, doors or the like with it. It is a separate part wherein the length of the time period can be set. Finally, in accordance with another preferred embodiment of this invention, the sensor is in the form of a damping body, the compression section of which preferably is more than 1 cm, measured in the direction of movement of the door.

BRIEF DESCRIPTION OF THE DRAWINGS

This invention will be better understood from the following detailed description taken in conjunction with the drawing which allows the invention used in conjunction with a garage door.

DESCRIPTION OF PREFERRED EMBODIMENTS

A garage door 14 in the shape of a sectional door is illustrated in the drawing. The garage door 14 comprises a plurality of plates 22, 24, 26, 28, guided in vertically oriented rails 30 and 32, which extend parallel to each other and adjoin rails 34 and 36, also extending parallel to each other, but disposed horizontally. The rails 34 and 36 are mounted on the ceiling of the garage with fastening means 38. The leading edge 27 of the door 14, which can be moved back and forth in the direction of the two-headed arrow 20, supports a sensor 18, which is connected to the safety device 10 by a line 8. The safety device 10 itself is connected to a drive device 12 of the door by a line 6.

The safety device 10 controls the movement sequence of the door 14, which cooperates with the drive device 12 with selectable operation loads, as well as with means through which the drive means 12 are switched off within a specified period of time in case a preselected operational load has been exceeded. The safety device 10 which, for example, can be fastened on a wall of the garage, is operationally connected to the sensor 18 and the drive device 12. The sensor 18 is designed in such a way that it can be placed in operational contact with obstacles crossing the movement path of the door 14, whereupon it emits a signal to the safety device 10 and causes the direction of movement of the door 14 to be changed if its movement has not been interrupted within a specific period of time after the emission of the signal. The sensor 18 is deformable, and can comprise rubber or plastic, for example. The operational position of the door 14 is illustrated in the drawing. In the position of rest, the plates 22, 24, 26, 28 are supported by the guide rails 34 and 36. If now the safety device is activated, the plates 22, 24, 26, 28 first move in a horizontal direction and then in the vertical direction until they have assumed the position illustrated in the drawing. In this case, the speed of movement of the plates depends on their position. If there is an obstacle between the ground 4 and the lowest plate 28, the sensor 18, disposed in the area of the leading edge 27 of the door 14, is brought into operational contact with the obstacle. As a result, the pressure changes inside the sensor, which has the shape of a resiliently deformable body extending along the leading edge 27 and is filled with gas or a liquid. The pressure wave is converted into electrical pulses in a converter of mechanical pulses. From there, the signal is sent to the safety device 10 through the line 8, which results in the time measuring unit being switched on, which measures the time within which the set operational load of the drive device 12 is exceeded. A first value, $\Delta T_{actual}$ is determined according to the formula $\Delta T_{actual}=T_2-T_1$. $\Delta T_{actual}$ is then compared to a preselected value, $T_{preselected}$. $T_{preselected}$ is a preselected value determined as a function of the maximum operational load of the drive device. With deformable obstacles, the operational load is exceeded later than with non-deformable obstacles, and thus $\Delta T_{actual}>T_{preselected}$, so that the drive device is reversed and the plates of the door move upward in the vertical direction. With non-deformable obstacles $\Delta T_{actual}<T_{preselected}$, and the drive device does not reverse. The sensitivity of the sensors can preferably be increased by designing them of a larger size. In this case, the sensor is at the same time embodied as a damping body, the compression section of which can be from about 1 centimeter up to several centimeters' length, measured in the direction of movement of the plates.

The advantages of this invention consist particularly in that it is possible to achieve with rather simple means not only interruption of the movement path of the door, but also reversal, so that a situation in which the obstacle is crushed cannot arise. In addition, the safety device (control device) is connected to a warning device which signals when the sensor is out of action. In this case, the signal of the drive device which indicates that the operational load of the drive device has been exceeded and that the sensor is out of action reaches the control device first. The sequence of the incoming signals, namely the one from the sensor and the one from the drive device, also provides the information as to whether the control device is operating correctly. If it is not operating correctly, the door can be operated by a dead-man switch.

I claim:

1. In a safety device for a passage closure having a drive, a maximum permissible load value of which can be set, and having a control device by which the drive can be switched off, switch-off occurring when the maximum permissible load value has been reached and a signal $S_2$ is sent to the control device at a time $T_2$, the improvement comprising:

a sensor (18) disposed in an area of a leading edge (27) of the passage closure (14), said sensor (18), when encountering an obstacle, emitting a signal $S_1$ to the control device at a time $T_1$, said control device, when reaching a maximum permissible load value of the passage closure at a time $T_2$ forming a difference value $\Delta T_{actual}=T_2-T_1$, and the control device comparing the difference value $\Delta T_{actual}$ with a preselected value $T_{preselected}$, whereby if $\Delta T_{actual}>\Delta T_{preselected}$, a direction of movement of the passage closure (14) is changed.

2. A safety device in accordance with claim 1, wherein the sensor is a pressure-sensitive body.

3. A safety device in accordance with claim 1, wherein the sensor (18) comprises a resiliently deformable body extending along the leading edge (27).

4. A safety device in accordance with claim 1, wherein the sensor (18) is a body made of one of rubber and plastic filled with one of a gas and a liquid, said sensor (18) connected by a line to a converter of mechanical pulses into electrical pulses.

5. A safety device in accordance with claim 4, wherein the converter is connected to the control device (10).

6. A safety device in accordance with claim 1, wherein the control device (10) is a stand-alone device in which the length of the time period $T_{vorgeg.}$ can be set.

7. A safety device in accordance with claim 1, wherein the control device is an integral part of the drive device.

8. A safety device in accordance with claim 1, wherein the sensor (18) is embodied as a damping body, said damping body comprising a compression section which is compressible greater than 1 cm, measured in the direction of movement of the door (14).

9. A safety device in accordance with claim 3, wherein the sensor (18) is a body made of rubber or plastic filled with a gas or a liquid, said sensor (18) connected by a line to a converter of mechanical pulses into electrical pulses.

10. A safety device in accordance with claim 9, wherein the converter is connected to the control device (10).

11. A safety device in accordance with claim 10, wherein the control device (10) is a stand-alone device in which the length of the time period $T_{preselected}$ can be set.

12. A safety device in accordance with claim 10, wherein the control device is an integral part of the drive device.

13. A safety device in accordance with claim 11, wherein the sensor (18) is embodied as a damping body, said damping body comprising a compression section which is compressible greater than 1 cm, measured in the direction of movement of the door (14).

14. A safety device in accordance with claim 12, wherein the sensor (18) is embodied as a damping body, said damping body comprising a compression section which is compressible greater than 1 cm, measured in the direction of movement of the door (14).

* * * * *